US009835010B2

(12) United States Patent
Anton et al.

(10) Patent No.: US 9,835,010 B2
(45) Date of Patent: Dec. 5, 2017

(54) TOE VALVE

(71) Applicant: TEAM OIL TOOLS, LP, The Woodlands, TX (US)

(72) Inventors: Kenneth J. Anton, Houston, TX (US); Michael J. Harris, Houston, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 261 days.

(21) Appl. No.: 14/569,927

(22) Filed: Dec. 15, 2014

(65) Prior Publication Data

US 2016/0168949 A1 Jun. 16, 2016

(51) Int. Cl.

| | |
|---|---|
| ***E21B 34/10*** | (2006.01) |
| ***E21B 34/14*** | (2006.01) |
| *E21B 34/00* | (2006.01) |

(52) U.S. Cl.

CPC ..... *E21B 34/10* (2013.01); *E21B 34/14* (2013.01); *E21B 2034/007* (2013.01)

(58) Field of Classification Search

CPC ..... E21B 34/14; E21B 34/10; E21B 2034/007
See application file for complete search history.

(56) References Cited

U.S. PATENT DOCUMENTS

| | | | | |
|---|---|---|---|---|
| 8,267,178 | B1 | 9/2012 | Sommers et al. | |
| 8,757,265 | B1 | 6/2014 | Cuffe et al. | |
| 8,863,853 | B1 | 10/2014 | Harris et al. | |
| 2008/0248560 | A1 | 10/2008 | Drummond | |
| 2010/0038861 | A1 | 2/2010 | Huang | |
| 2012/0042966 | A1* | 2/2012 | Ross | E21B 34/103 137/517 |
| 2012/0279723 | A1* | 11/2012 | Hofman | E21B 34/063 166/373 |
| 2013/0056206 | A1* | 3/2013 | Jackson | E21B 34/102 166/281 |
| 2013/0199800 | A1 | 8/2013 | Kellner et al. | |
| 2014/0060852 | A1* | 3/2014 | Smith | E21B 23/04 166/373 |
| 2014/0202706 | A1* | 7/2014 | Howell | E21B 34/102 166/374 |

(Continued)

OTHER PUBLICATIONS

Hun Gil Lee (Authorized Officer), International Search Report and Written Opinion dated Mar. 25, 2016, PCT Application No. PCT/US2015/064659, filed Dec. 9, 2015, pp. 1-13.

(Continued)

*Primary Examiner* — Giovanna C. Wright
(74) *Attorney, Agent, or Firm* — MH2 Technology Law Group, LLP

(57) ABSTRACT

A downhole tool including a body having one or more openings. A main sleeve is disposed in the body. The main sleeve is configured to move between a first position in which the main sleeve blocks fluid flow through the one or more openings and a second position in which the main sleeve allows fluid flow through the one or more openings. An actuator is disposed in the body. The actuator is configured to actuate from a first state to a second state in response to application of a first level of pressure, and to a third state in response to application of a second level of pressure. Actuating the actuator to the third state causes the main sleeve to move from the first position to the second position, and the second level of pressure is less than or equal to the first level or pressure.

20 Claims, 7 Drawing Sheets

(56) References Cited

U.S. PATENT DOCUMENTS

| | | | | |
|---|---|---|---|---|
| 2014/0203525 | A1 | 7/2014 | Bordeianu et al. | |
| 2015/0267503 | A1* | 9/2015 | Foong | E21B 33/1293 166/378 |

OTHER PUBLICATIONS

Kenneth J. Anton et al., "Method and Apparatus for Smooth Bore Toe Valve", U.S. Appl. No. 13/924,828, filed Jun. 24, 2013.
Team Oil Tools, "ORIO Toe Valve", http://www.teamoiltools.com/content/documents/product_data_sheets/01_T-Frac_System/ORIO_toe_valve_BE_web.pdf, Retrieved from the internet Dec. 1, 2014, 1 page.
Michael J. Harris et al., "Method and Apparatus for Actuating a Downhole Tool", U.S. Appl. No. 14/073,706, filed Nov. 6, 2013.

* cited by examiner

TOE VALVE

BACKGROUND

A toe valve may be positioned at the bottom of a cemented casing completion in a horizontal or deviated wellbore. The toe valve may include a sliding sleeve that moves from a first, closed position to a second, open position. When the sliding sleeve is in the open position, a path of fluid communication is established from a bore in the toe valve to the exterior of the toe valve for circulation. This may occur prior to treatment operations in the wellbore.

Once the toe valve is in the desired location in the wellbore, the integrity of the casing may be tested. This may be accomplished by increasing the pressure of the fluid in the wellbore to a first level (e.g., higher than the pressure required to hydraulically fracture the surrounding formation). Subsequent to the integrity of the casing being confirmed, the sliding sleeve may be moved from the closed position to the open position. This may be accomplished by increasing the pressure of the fluid in the wellbore to a second level. The second level is higher than the first level to avoid the sliding sleeve inadvertently moving to the open position during testing. However, because the pressure needed to open the toe valve exceeds the pressure at which the casing integrity is tested, opening the toe valve may risk damaging the casing.

SUMMARY

A downhole tool is disclosed. The downhole tool includes a body having one or more openings. A main sleeve is disposed in the body. The main sleeve is configured to move between a first position in which the main sleeve blocks fluid flow through the one or more openings and a second position in which the main sleeve allows fluid flow through the one or more openings. An actuator is disposed in the body. The actuator is configured to actuate from a first state to a second state in response to application of a first level of pressure, and to a third state in response to application of a second level of pressure. Actuating the actuator to the third state causes the main sleeve to move from the first position to the second position, and the second level of pressure is less than or equal to the first level or pressure.

In another embodiment, the downhole tool includes a body having an axial bore, a first radial opening, and a second radial opening. A first drive sleeve is positioned in the body. A second drive sleeve is positioned in the body and at least partially axially-offset from the first drive sleeve. The second drive sleeve prevents fluid flow through the second radial opening when the second drive sleeve is in a first position. The first drive sleeve moves the second drive sleeve from the first position to a second position in response to a first level pressure applied thereto through the first radial opening. The second drive sleeve prevents fluid flow through the second radial opening when the second drive sleeve is in the second position. The first drive sleeve moves the second drive sleeve from the second position to a third position in response to a second level of pressure being applied thereto through the first radial opening. The second level of pressure is less than or equal to the first level of pressure.

A method for operating a downhole tool is also disclosed. The method includes running the downhole tool into a wellbore. A pressure of a fluid in the wellbore is increased to a first level to perform a wellbore operation. The pressure of the fluid decreases after the pressure reaches the first level. The pressure of the fluid increases to a second level that is less than or equal to the first level to actuate the downhole tool and to allow fluid flow through the downhole tool.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
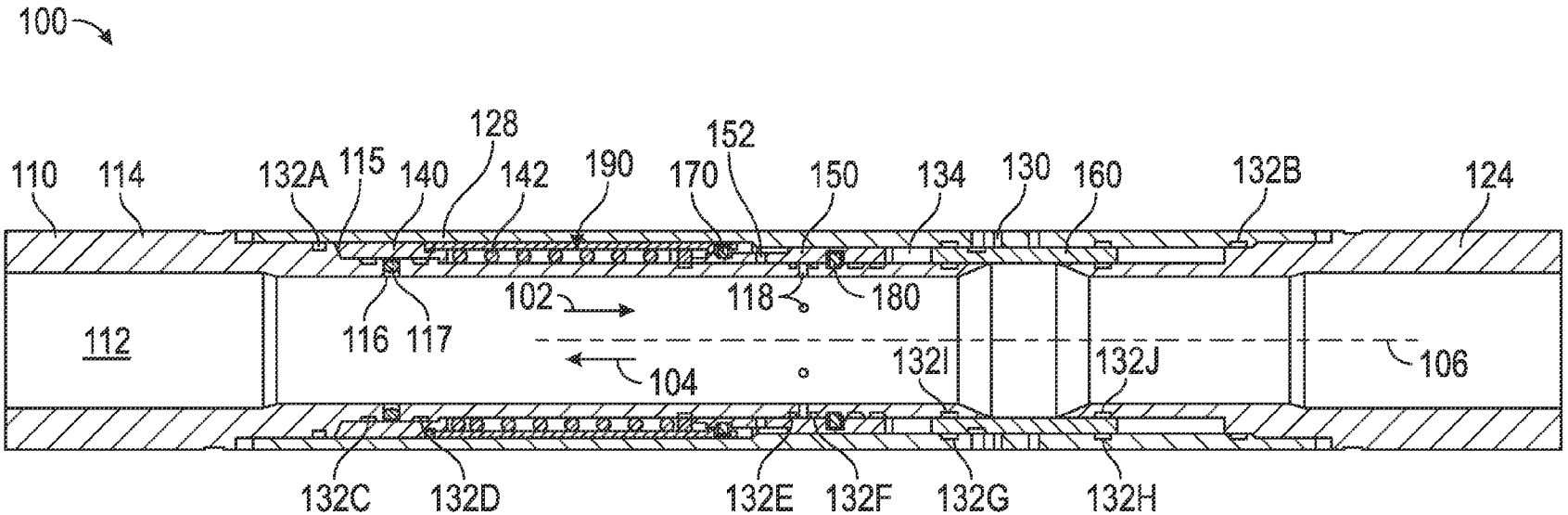
FIG. 1 illustrates a cross-sectional side view of a downhole tool in a first, run-in position, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, the present disclosure provides a downhole tool, such as a toe valve, that includes a plurality of sleeves and at least one ring (e.g., a ratchet ring). The at least one ring may be configured to move in one axial direction within the downhole tool but not the opposing axial direction. Together, the sleeves and the at least one ring may cooperate to allow the downhole tool to actuate from a first position when the downhole tool is run into the wellbore to a second position when the wellbore is being pressure tested. The downhole tool may then actuate into a third position as the pressure in the wellbore decreases after the pressure testing. The downhole tool may then actuate into a fourth position when the pressure is increased again, and a path of fluid communication from a bore in the downhole tool to an exterior of the downhole tool may exist in the fourth position. The downhole tool may actuate from the third position to the fourth position in response to a pressure that is less than or equal to the pressure that causes the downhole tool to actuate from the first position to the second position.

Turning to the specific, illustrated embodiments, FIG. 1 illustrates a cross-sectional side view of a downhole tool 100 in a first, run-in position, according to an embodiment. The downhole tool 100 may be any tool that is designed to be run into a wellbore and circulate a fluid in the wellbore. As shown, the downhole tool 100 may be a toe valve. The downhole tool 100 may include a body 110 having a bore 112 formed at least partially therethrough. The body 110 may be one component, or the body 110 may be two or more components coupled together. As shown, the body 110 includes a first or "upper" sub 114 and a second or "lower" sub 124. The upper and lower subs 114, 124 may be spaced axially-apart from one another. The body 110 may also include a housing 128 coupled to and positioned at least partially between the upper and lower subs 114, 124.

A seal 132A may be positioned radially-between the upper sub 114 and the housing 128. Another seal 132B may be positioned radially-between the lower sub 124 and the housing 128. The seals 132A, 132B may be made of a polymer or elastomer (e.g., rubber) and designed to prevent fluid flow between adjacent components. In at least one embodiment, the seals 132A, 132B may be O-rings.

The upper sub 114 may have one or more first openings 116 formed radially therethrough. The first openings 116 may have burst or rupture discs 117 positioned therein that prevent fluid flow through the first openings 116. The burst discs 117 are configured to burst when a pressure of the fluid in the bore 112 exceeds a predetermined level to provide a path of fluid communication from the bore 112, through the first openings 116, and into at least a portion of an annulus 134 formed between the upper sub 114 and the housing 128. In other embodiments, instead of or in addition to burst discs 117, the first openings 116 may include valves, sliding sleeves, or the like to selectively allow fluid flow through the first openings 116.

The upper sub 114 may also have one or more second openings 118 formed radially therethrough. The second openings 118 may provide a path of fluid communication between the bore 112 and at least a portion of the annulus 134. The second openings 118 may be axially-offset (e.g., as proceeding along a central longitudinal axis 106 of the downhole tool 100) from the first openings 116. As shown, the second openings 118 may be positioned below or downstream from the first openings 116.

The housing 128 may also have one or more openings 130 formed radially therethrough. The openings 130 may be positioned between the upper and lower subs 114, 124. The openings 130 may provide a path of fluid communication between the annulus 134 and an exterior of the housing 128. As shown, the openings 130 in the housing 128 are axially-offset (e.g., below or downstream) from the second openings 118 in the upper sub 114; however, in other embodiments, the openings 118, 130 may be axially-aligned with one another.

One or more annular sleeves (three are shown: 140, 150, 160) may be positioned within the body 110. More particularly, a first drive sleeve 140 may be positioned at least partially between the upper sub 114 and the housing 128. Seals 132C, 132D may be positioned radially-between the upper sub 114 and the first drive sleeve 140 and on opposing axial sides of the first openings 116 in the upper sub 114.

A second drive sleeve 150 may also be positioned at least partially between the upper sub 114 and the housing 128. The second drive sleeve 150 may be positioned below or downstream from the first drive sleeve 140. Seals 132E, 132F may be positioned radially-between the upper sub 114 and the second drive sleeve 150 and on opposing axial sides of the second openings 118 in the upper sub 114.

The second drive sleeve 150 may have one or more openings 152 formed radially therethrough. The openings 152 in the second drive sleeve 150 may be axially-offset and/or circumferentially-offset from the second openings 118 in the upper sub 114 when the downhole tool 100 is in the run-in position. As such, the second drive sleeve 150 (and the seals 132E, 132F) may prevent fluid from flowing through the second openings 118 in the upper sub 114.

A third "main" sleeve 160 may be positioned at least partially between the upper sub 114 and/or the lower sub 124 on one side and the housing 128 on the other side. The main sleeve 160 may be positioned below or downstream from the second drive sleeve 150. The main sleeve 160 may be axially-aligned with the openings 130 in the housing 128 when the downhole tool 100 is in the run-in position. As such, the main sleeve 160 may prevent fluid from flowing through the openings 130 in the housing 128.

Seals 132G, 132H may be positioned radially-between the main sleeve 160 and the housing 128 and on opposing axial sides of the openings 130 in the housing 128. Similarly, additional seals 1321, 132J may be positioned radially-between the main sleeve 160 on one side and the upper and/or lower subs 114, 124 on the other side and on opposing axial sides of the openings 130 in the housing 128.

A biasing member 142 may be positioned proximate to the first drive sleeve 140. The biasing member 142 may be a spring, a Bellville washer, or the like. The biasing member 142 may be axially-adjacent to at least a portion of the first drive sleeve 140. As shown, the biasing member 142 is positioned radially-between the upper sub 114 and the first drive sleeve 140. In other embodiments, the biasing member 142 may be positioned radially-between the first drive sleeve 140 and the housing 128. The biasing member 142 may exert a force on the first drive sleeve 140 in an upstream direction 104 (e.g., to the left, as shown in FIG. 1) to bias the first drive sleeve 140 into the position shown in FIG. 1.

A first ring 170 may be positioned radially-between the first and second drive sleeves 140, 150. A second ring 180 may be positioned radially-between the second drive sleeve 150 and the upper sub 114. In another embodiment, the second ring 180 may be positioned radially-between the second drive sleeve 150 and the housing 128. The first and second rings 170, 180 may be ratchet rings that transfer force and/or movement from one component to another. Despite being described as "rings," the first and second rings 170, 180 may not extend around for the full 360 degrees. Rather, a gap may be formed between the two ends such that the rings 170, 180 are substantially "C-shaped." This may allow the cross-sectional length (e.g., diameter) of the rings 170, 180 to expand and collapse based at least partially upon the outer diameter of the surface that they are positioned around.

The first drive sleeve 140, the biasing member 142, the second drive sleeve 150, the first ring 170, the second ring 180, or a combination thereof may function as a linear actuator 190. The linear actuator 190 may be positioned at least partially around the upper sub 114, the lower sub 124, or a combination thereof. As described in greater detail below, the linear actuator 190 may actuate from a first state (FIG. 1) to a second state (FIG. 5) in response to a first level of pressure in the bore 112. The linear actuator 190 may then actuate into a third state (FIG. 7) in response to a second level of pressure in the bore 112. The second level of pressure may be less than or equal to the first level of pressure. The main sleeve 160 may prevent fluid flow through the openings 130 when the linear actuator 190 is in the first and second states. The main sleeve 160 may move such that a path of fluid communication exists between the bore 112 and the exterior of the housing 128 (through the openings 130) when the linear actuator 190 is in the third state. The linear actuator 190 moves in a linear/axial direction. In at least some embodiments, the linear actuator 190 may thus actuate without relying on, and may potentially restrain, rotational movement of its component parts. The linear actuator 190 does not rotate as it moves.

Figure 2:
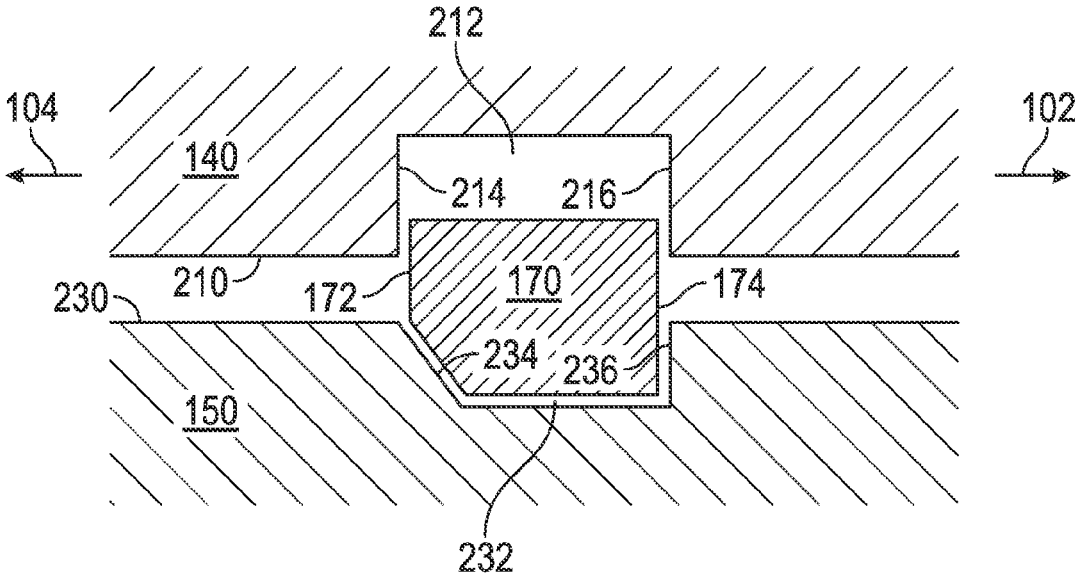
FIG. 2 illustrates an enlarged cross-sectional side view of a portion of the downhole tool shown in FIG. 1 including a first ring, according to an embodiment.

FIG. 2 illustrates an enlarged cross-sectional side view of a portion of the downhole tool 100 shown in FIG. 1 including the first ring 170, according to an embodiment. The inner surface 210 of the first drive sleeve 140 may define a recess 212. The outer surface 230 of the second drive sleeve 150 may also define a recess 232. The first ring 170 may be positioned in the recesses 212, 232 when the downhole tool 100 is in the run-in position.

The upstream and downstream surfaces 214, 216 that define the recess 212 in the first drive sleeve 140 may be substantially perpendicular to the central longitudinal axis 106 through the body 110. At least a portion of the upstream and downstream surfaces 172, 174 of the first ring 170 may also be substantially perpendicular to the central longitudinal axis 106 through the body 110. As such, the first ring 170 may remain within the recess 212 in the first drive sleeve 140 when the first drive sleeve 140 moves in either axial direction.

Similarly, the downstream surface 236 that defines the recess 232 in the second drive sleeve 150 may be substantially perpendicular to the central longitudinal axis 106 through the body 110. At least a portion of the downstream surface 174 of the first ring 170 may also be substantially perpendicular to the central longitudinal axis 106 through the body 110. As such, the first ring 170 may remain in the recess 232 in the second drive sleeve 150 when the first drive sleeve 140 moves in the downstream direction 102 (e.g., to the right, as shown in FIG. 2).

As shown, in at least one embodiment, the upstream surface 234 of the second drive sleeve 150 that defines the recess 232 may be sloped. More particularly, an angle between the upstream surface 234 and the central longitudinal axis 106 through the body 110 may be from about 10 degrees to about 80 degrees, about 20 degrees to about 70 degrees, or about 30 degrees to about 60 degrees. At least a portion of the upstream surface 172 of the first ring 170 may also be sloped at substantially the same angle. As such, when the first drive sleeve 140 moves in the upstream direction 104 with respect to the second drive sleeve 150, the upstream surface 172 of the first ring 170 may slide along the upstream surface 234 of the second drive sleeve 150 until the first ring 170 is no longer positioned in the recess 232 in the second drive sleeve 150. The first ring 170 may, however, remain within the recess in the first drive sleeve 140.

Figure 3:
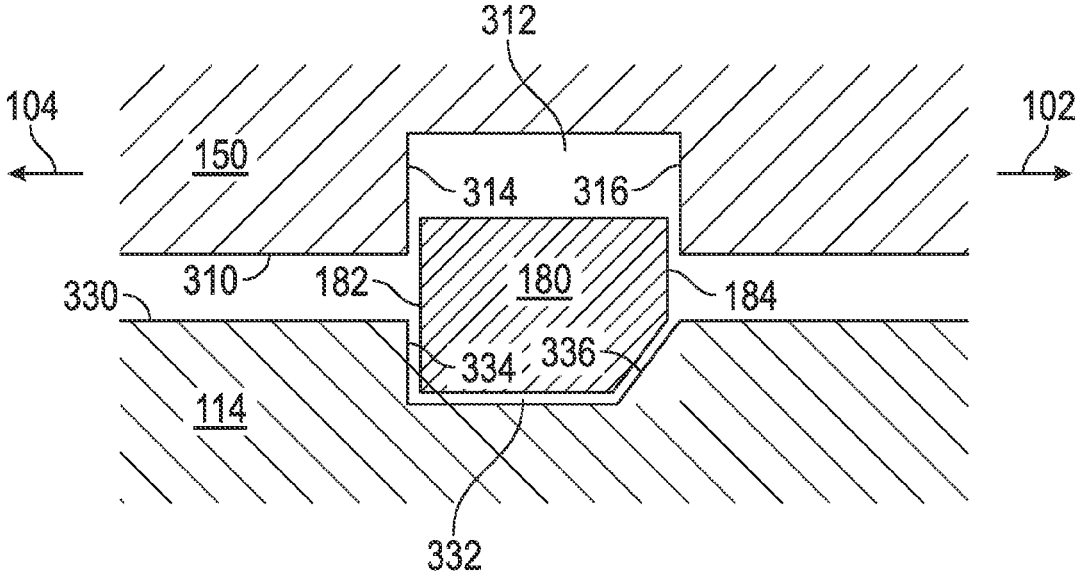
FIG. 3 illustrates an enlarged cross-sectional side view of a portion of the downhole tool shown in FIG. 1 including a second ring, according to an embodiment.

FIG. 3 illustrates an enlarged cross-sectional side view of a portion of the downhole tool 100 shown in FIG. 1 including the second ring 180, according to an embodiment. The inner surface 310 of the second drive sleeve 150 may define a recess 312. The outer surface 330 of the upper sub 114 may also define a recess 332. The second ring 180 may be positioned in the recesses 312, 332 when the downhole tool 100 is in the run-in position.

The upstream and downstream surfaces 314, 316 that define the recess 312 in the second drive sleeve 150 may be substantially perpendicular to the central longitudinal axis 106 through the body 110. At least a portion of the upstream and downstream surfaces 182, 184 of the second ring 180 may also be substantially perpendicular to the central longitudinal axis 106 through the body 110. As such, the second ring 180 may remain within the recess 312 in the second drive sleeve 150 when the second drive sleeve 150 moves in either axial direction.

Similarly, the upstream surface 334 that defines the recess 332 in the upper sub 114 may be substantially perpendicular to the central longitudinal axis 106 through the body 110. At least a portion of the upstream surface 182 of the second ring 180 may also be substantially perpendicular to the central longitudinal axis 106 through the body 110. As such, the second ring 180 may remain in the recess 332 in the upper sub 114 when the second drive sleeve 150 moves in the upstream direction 104.

As shown, in at least one embodiment, the downstream surface 336 of the upper sub 114 that defines the recess 332 may be sloped. More particularly, an angle between the downstream surface 334 and the central longitudinal axis 106 through the body 110 may be from about 10 degrees to about 80 degrees, about 20 degrees to about 70 degrees, or about 30 degrees to about 60 degrees. At least a portion of the downstream surface 184 of the second ring 180 may also be sloped at substantially the same angle. As such, when the second drive sleeve 150 moves in the downstream direction 102 with respect to the upper sub 114, the downstream surface 184 of the second ring 180 may slide along the downstream surface of the upper sub 114 until the second ring 180 is no longer positioned in the recess 332 in the upper sub 114. The second ring 180 may, however, remain within the recess in the second drive sleeve 150.

Figure 4:
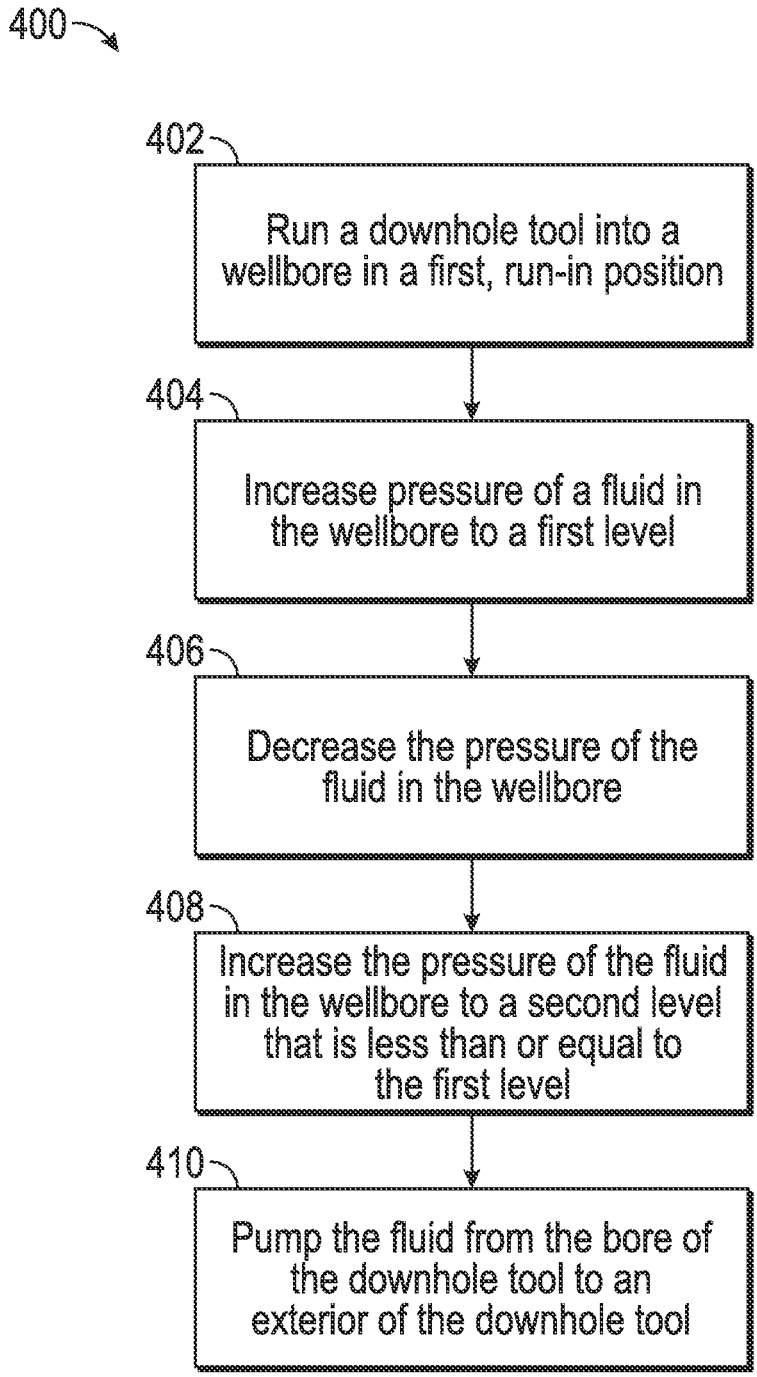
FIG. 4 illustrates a flowchart of a method for actuating the downhole tool, according to an embodiment.

FIG. 4 illustrates a flowchart of a method 400 for actuating the downhole tool 100, according to an embodiment.

The method 400 is shown and described with respect to FIGS. 1 and 5-7. The downhole tool 100 may be run into the wellbore in the run-in position, as at 402 (and as shown in FIG. 1, according to an embodiment). In at least one embodiment, the downhole tool 100 may be run into the wellbore until it is located proximate to the end of a horizontal or deviated portion of the wellbore (i.e., the toe of the wellbore).

Figure 5:
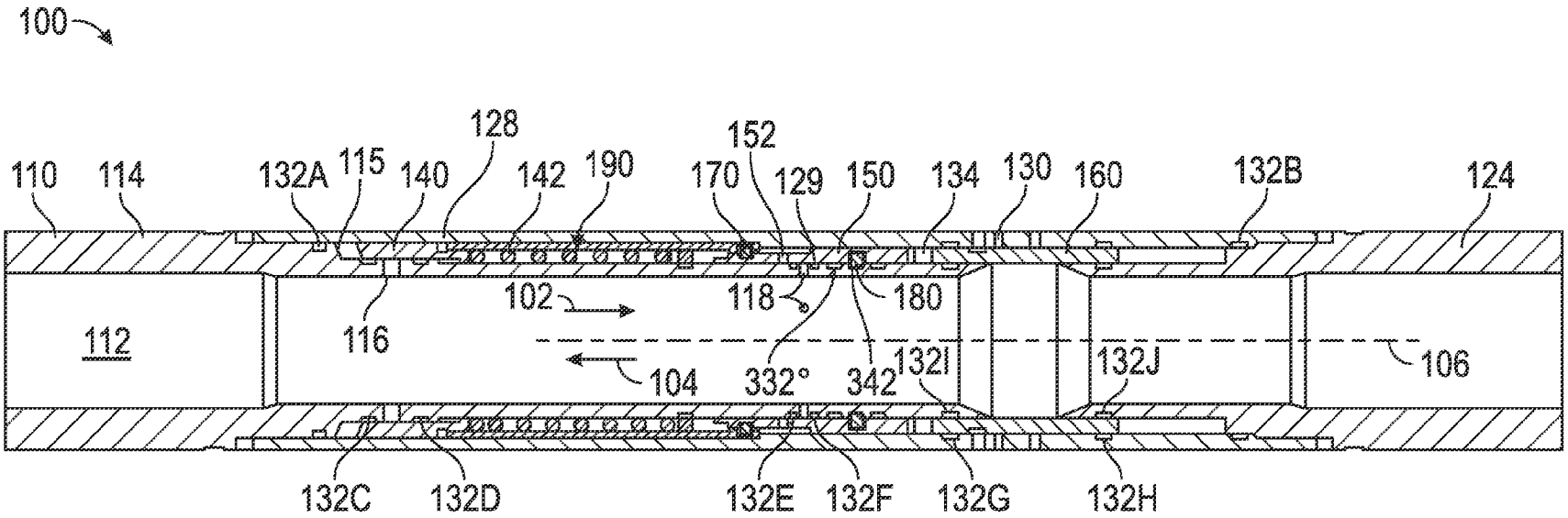
FIG. 5 illustrates a cross-sectional side view of the downhole tool in a second position after a rupture disk ruptures and a pressure of a fluid in the bore increases, according to an embodiment.

Once located in the desired position in the wellbore, the downhole tool 100 may be actuated into a second position, as shown in FIG. 5. To actuate the downhole tool 100 into the second position, a pressure of the fluid in the wellbore may be increased (e.g., by a pump located at the surface) to a first level to test the integrity of the casing in the wellbore, as at 404 in FIG. 4. The burst discs 117 may burst as the pressure of the fluid is increased to the first level, thereby providing a path of fluid communication from the bore 112, through the first openings 116 in the upper sub 114, and into at least a portion of the annulus 134 formed between the upper sub 114 and the housing 128. The pressurized fluid may exert a force on one or more piston surfaces on the inner diameter of the first drive sleeve 140, e.g., two or more surfaces of different surface areas, such that a net force is exerted.

In at least one embodiment, an upstream surface 115 of the upper sub 114 that defines the annulus 134 may be sloped with respect to the central longitudinal axis 106 through the body 110. An angle between the upstream surface 115 and the central longitudinal axis 106 through the body 110 may be from about 10 degrees to about 80 degrees, about 20 degrees to about 70 degrees, or about 30 degrees to about 60 degrees. This sloped upstream surface 115 may provide a surface area differential that enables force exerted on the first drive sleeve 140 by the pressurized fluid in the annulus 134 to exceed the opposing force exerted on the first drive sleeve 140 by the biasing member 142. This may cause the first drive sleeve 140 to move in the downstream direction 102.

The movement of the first drive sleeve 140 may cause the second drive sleeve 150 to move in the downstream direction 102 due to (e.g., direct) contact between the first and second drive sleeves 140, 150. In another embodiment, the movement of the first drive sleeve 140 may cause the second drive sleeve 150 to move in the downstream direction 102 due to the engagement of the first and second drive sleeves 140, 150 with the first ring 170. This movement may cause a shear mechanism (not shown), which previously held the second drive sleeve 150 in place, to break. The shear mechanism may be a pin, screw, bolt, or the like that is configured to break when exposed to a predetermined axial and/or rotational force.

The first ring 170 may remain positioned within the recesses 212, 232 (FIG. 2) in the first and second drive sleeves 140, 150, respectively, as the first and second drive sleeves 140, 150 move in the downstream direction 102. The second ring 180 may remain positioned in the recess 312 in the second drive sleeve 150 as the first and second drive sleeves 140, 150 move in the downstream direction 102. However, the second ring 180 may slide out of the recess 332 in the upper sub 114 into a second recess 342 in the upper sub 114 as the first and second drive sleeves 140, 150 move in the downstream direction 102. The second recess 342 in the upper sub 114 may be positioned downstream from the first recess 332 in the upper sub 114. The first and second drive sleeves 140, 150 may move in the downstream direction 102 until the first drive sleeve 140 contacts a shoulder 129 formed on the inner surface of the housing 128 (or the upper sub 114 or the lower sub 124), which prevents further movement in the downstream direction 102. As such, the movement of the first and second drive sleeves 140, 150 may not cause the main sleeve 160 to move during the pressure testing.

Figure 6:
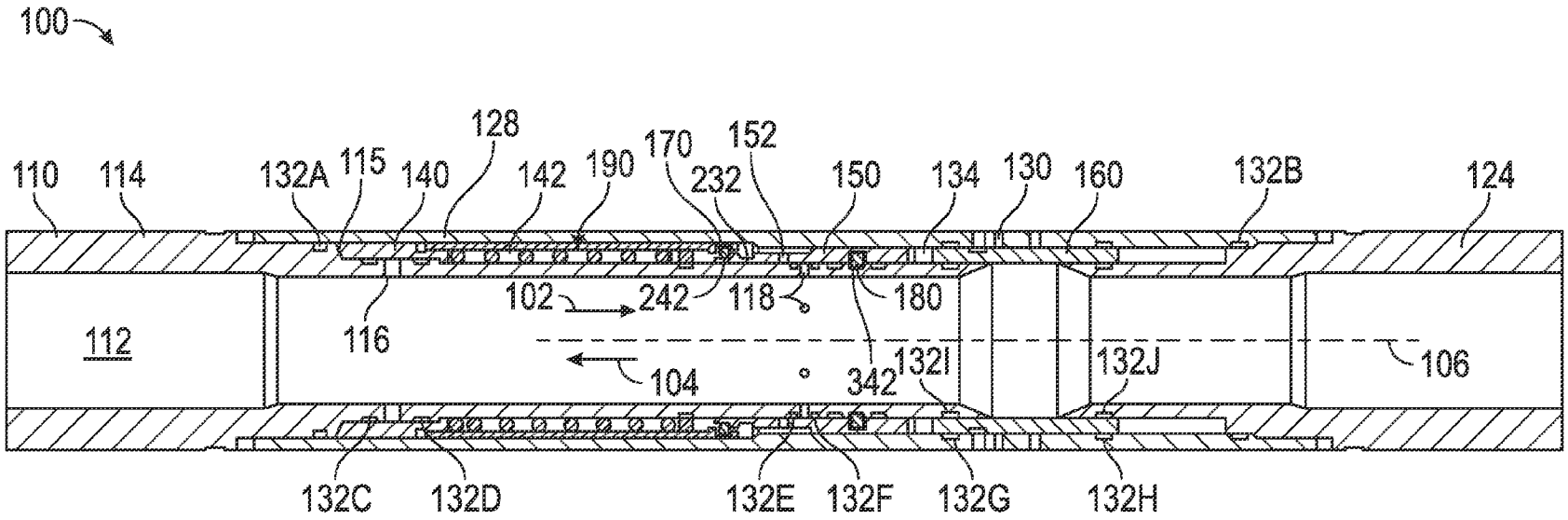
FIG. 6 illustrates a cross-sectional side view of the downhole tool in a third position after the pressure of the fluid in the bore decreases, according to an embodiment.

Once the pressure testing is complete, the downhole tool 100 may be actuated into a third position, as shown in FIG. 6. The pressure of the fluid in the wellbore may be decreased (e.g., back to hydrostatic pressure) after the pressure reaches the first level, as at 406 in FIG. 4. As the pressure decreases, the force exerted on the first drive sleeve 140 in the upstream direction 104 by the biasing member 142 may overcome the opposing force exerted on the first drive sleeve 140 in the downstream direction 102 by the pressurized fluid. This may cause the first drive sleeve 140 to move in the upstream direction 104 into its initial position.

The second drive sleeve 150 may not move together with the first drive sleeve 140 in the upstream direction 104. Rather, the second drive sleeve 150 may be stationary with respect to the upper sub 114 because the second ring 180 may remain positioned within the recess 312 in the second drive sleeve 150 and in the second recess 342 in the upper sub 114. The first ring 170, however, may move together with the first drive sleeve 140 in the upstream direction 104. More particularly, the first ring 170 may remain positioned within the recess 212 in the first drive sleeve 140. However, the first ring 170 may slide out of the recess 232 in the second drive sleeve 150 into a second recess 242 defined in or by the second drive sleeve 150. The second recess 242 in the second drive sleeve 150 may be upstream from the first recess 232 in the second drive sleeve 150.

Figure 7:
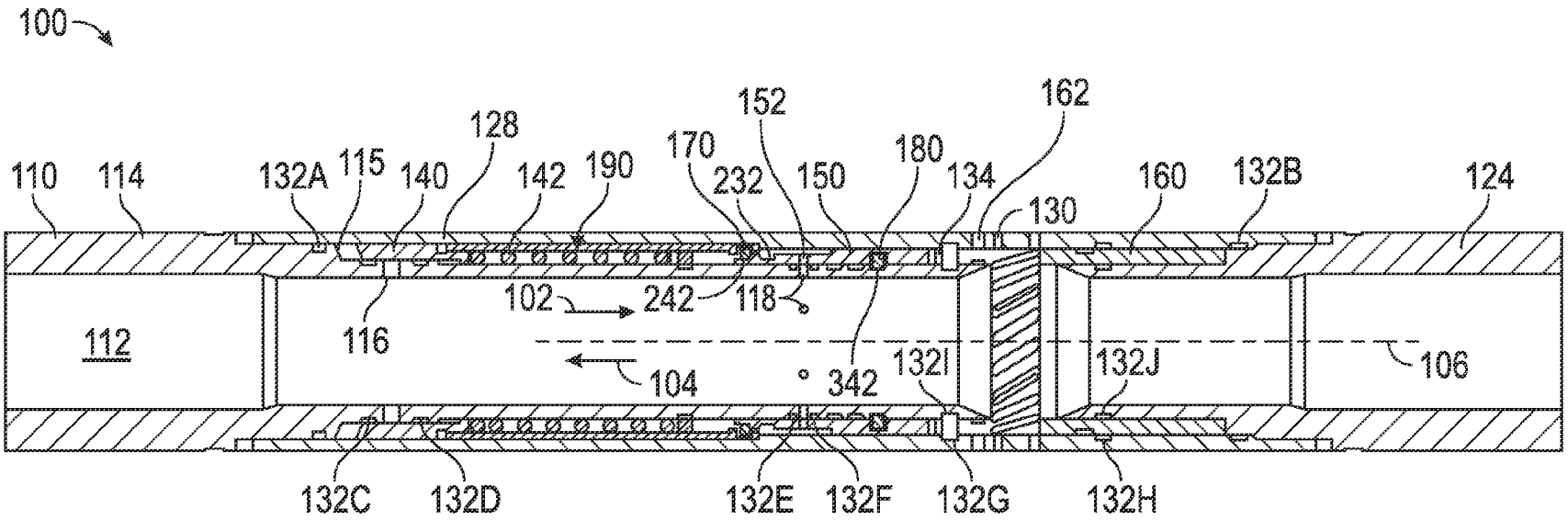
FIG. 7 illustrates a cross-sectional side view of the downhole tool in a fourth position after the pressure of the fluid in the bore is increased again to create a path of fluid communication between the bore and an exterior of the downhole tool, according to an embodiment.

FIG. 7 illustrates the downhole tool 100 in a fourth position, according to an embodiment. The pressure of the fluid in the wellbore may be increased again (e.g., by the pump at the surface) to a second level, as at 408 in FIG. 4. The second level may be less than or equal to the first level described above. The fluid may flow from the bore 112, through the first openings 116 in the upper sub 114, and into the annulus 134 again. The force exerted on the first drive sleeve 140 by the pressurized fluid in the downstream direction 102 may exceed the opposing force exerted by the biasing member 142 in the upstream direction 104. This may cause the first drive sleeve 140 to move in the downstream direction 102 again.

The movement of the first drive sleeve 140 may cause the second drive sleeve 150 to move in the downstream direction 102 due to the engagement of the first and second sleeves 140, 150 with the first ring 170. The first and second drive sleeves 140, 150 may move in the downstream direction 102 until the first drive sleeve 140 contacts the shoulder 129 formed on the inner surface of the housing 128. At this point, the second drive sleeve 150 may be positioned farther downstream than it was when the downhole tool 100 was in the second position (FIG. 5) because the first ring 170 is positioned in the second recess 242 in the second drive sleeve 150, which is upstream from the first recess 232 in the second drive sleeve 150. When the second drive sleeve 150 is in this position, the openings 152 in the second drive sleeve 150 may be aligned with the second openings 118 in the upper sub 114. This establishes a path of fluid communication from the bore 112, through the openings 118, 152, and into the annulus 134.

Once the pressurized fluid from the bore 112 enters the annulus 134 through the second openings 118 in the upper sub 114, the pressurized fluid may exert a force on the main sleeve 160 in the downstream direction 102. This force may cause a shear mechanism 162 holding the main sleeve 160 in place to break, and the main sleeve 160 may then move in the downstream direction 102. Once the main sleeve 160 has moved in the downstream direction 102, the main sleeve 160 may no longer obstruct the openings 130 in the housing 128. Accordingly, a path of fluid communication may exist from the bore 112, through the axial gap between the upper and lower subs 114, 124, through the openings 130, and to the exterior of the housing 128.

Figure 8:
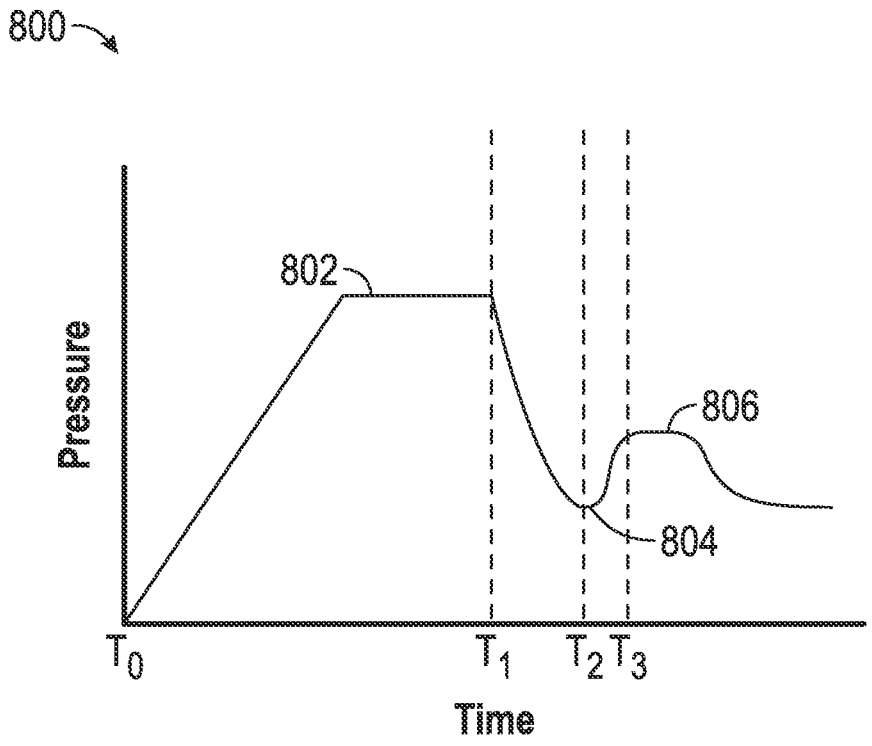
FIG. 8 illustrates a graph of pressure vs. time during the actuation of the downhole tool, according to an embodiment.

FIG. 8 illustrates a graph 800 of pressure vs. time during the actuation of the downhole tool 100, according to an embodiment. The graph 800 may represent the pressure seen at the surface (e.g., at the pump that pumps fluid into the wellbore). As may be seen, the pressure of the fluid in the bore 112 of the downhole tool 100 may increase and then level off at the first pressure (shown at 802) at which the casing is to be tested. The downhole tool 100 may actuate from the first position (FIG. 1) to the second position (FIG. 5) during the pressure testing (e.g., between $T_0$ and $T_1$). The pressure of the fluid may then decrease to a point 804. The downhole tool 100 may actuate from the second position (FIG. 5) to the third position (FIG. 6) as the pressure decreases (e.g., between $T_1$ and $T_2$). The pressure of the fluid may then be increased again to a second pressure, as shown at point 806, which may be less than or equal to the first pressure. The downhole tool 100 may actuate from the third position (FIG. 6) to the fourth position (FIG. 7) as the pressure increases (e.g., between $T_2$ and $T_3$). The pressure of the fluid may then remain at the second pressure, level off at a formation (injection) pressure, or decrease back to the hydrostatic pressure.

As used herein, the terms "inner" and "outer"; "up" and "down"; "upper" and "lower"; "upward" and "downward"; "above" and "below"; "inward" and "outward"; "upstream" and "downstream"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a body having one or more openings;

a main sleeve disposed in the body, the main sleeve being configured to move between a first position in which the main sleeve blocks fluid flow through the one or more openings and a second position in which the main sleeve allows fluid flow through the one or more openings; and an actuator disposed in the body, the actuator being configured to actuate by linear movement, without relying on any portion of the actuator rotating with respect to the body, from a first state to a second state in response to application of a first level of pressure, and to a third state in response to application of a second level of pressure, wherein actuating the actuator to the third state causes the main sleeve to move from the first position to the second position, wherein the second level of pressure is less than or equal to the first level of pressure, wherein the actuator comprises:

a first drive sleeve positioned in the body;

a second drive sleeve positioned in the body and axially-offset from the first drive sleeve, wherein the second drive sleeve defines a first recess and a second recess; and a first ring positioned between the first and second drive sleeves, wherein the first ring is positioned in the first recess in the second drive sleeve when the actuator is in the first state, the second state, or both, wherein the first ring is positioned in the second recess in the second drive sleeve when the actuator is in the third state, wherein the first recess in the second drive sleeve is downstream from the second recess in the second drive sleeve, and wherein the first ring moves linearly without rotating between the first recess in the second drive sleeve and the second recess in the second drive sleeve.

2. The downhole tool of claim 1, wherein the body comprises a first sub, a second sub, and a housing positioned at least partially around the first sub, the second sub, or both, and wherein at least one of the one or more openings is positioned axially-between the first and second subs.

3. The downhole tool of claim 1, wherein no portion of the actuator substantially rotates with respect to the body when the actuator actuates.

4. The downhole tool of claim 1, wherein the actuator further comprises a second ring positioned between the second drive sleeve and the body, wherein the second ring is positioned in a first recess in the body when the actuator is in the first state, wherein the second ring is positioned in a second recess in the body when the actuator is in the second state, the third state, or both, wherein the first recess in the body is upstream from the second recess in the body, and wherein the second ring moves linearly without substantially rotating between the first recess in the body and the second recess in the body.

5. A downhole tool, comprising:

a body having an axial bore, a first radial opening, and a second radial opening;

a first drive sleeve positioned in the body; and a second drive sleeve positioned in the body and at least partially axially-offset from the first drive sleeve, the second drive sleeve preventing fluid flow through the second radial opening when the second drive sleeve is in a first position, wherein the first drive sleeve moves the second drive sleeve in a downstream direction from the first position to a second position in response to a first level of pressure applied thereto through the first radial opening, the second drive sleeve prevents fluid flow through the second radial opening when the second drive sleeve is in the second position, and the first drive sleeve moves the second drive sleeve in a downstream direction from the second position to a third position in response to a second level of pressure being applied thereto through the first radial opening, the second level of pressure being less than or equal to the first level of pressure, wherein the second drive sleeve permits fluid flow through the first second radial opening in the body in the third position.

6. The downhole tool of claim 5, further comprising a burst disc positioned in the first radial opening in the body.

7. The downhole tool of claim 5, further comprising:

a first ring positioned at least partially between the first and second drive sleeves; and a second ring positioned at least partially between the second drive sleeve and the body, wherein the first and second ring move linearly without substantially rotating with respect to the body.

8. The downhole tool of claim 7, wherein the second ring is positioned in a first recess in the body when the second sleeve is in the first position, and wherein the second ring is configured to move into a second recess in the body when the second sleeve moves to the second position.

9. The downhole tool of claim 8, wherein the second recess in the body is downstream from the first recess in the body.

10. The downhole tool of claim 8, wherein the first ring is positioned in a first recess in the second drive sleeve when the second drive sleeve is in the first position, the second position, or both, and wherein the first ring is configured to move into a second recess in the second drive sleeve when the second drive sleeves moves into the third position.

11. The downhole tool of claim 10, wherein the second recess in the second drive sleeve is upstream from the first recess in the second drive sleeve.

12. The downhole tool of claim 10, wherein the second drive sleeve has an opening formed radially therethrough that is aligned with the second radial opening in the body when the second drive sleeve is in the third position.

13. The downhole tool of claim 12, further comprising a main sleeve positioned in the body and at least partially axially-offset from the first and second drive sleeves, wherein the main sleeve prevents fluid flow through a third radial opening in the body when the second drive sleeve is in the first position, the second position, or both.

14. The downhole tool of claim 13, wherein fluid flow is permitted through the third radial opening in the body to an exterior of the body when the second drive sleeve is in the third position.

15. The downhole tool of claim 14, wherein the second drive sleeve moves into the third position in response to a pressure of a fluid in the bore that is less than or equal to a pressure of the fluid in the bore that causes the second drive sleeve to move into the second position.

16. The downhole tool of claim 5, further comprising a first ring positioned at least partially between the first and second drive sleeves, wherein the first ring moves linearly with respect to the body, without rotating relative to the body.

17. A method for operating a downhole tool, comprising:

running the downhole tool into a wellbore, wherein the downhole tool comprises a body having one or more openings and an actuator disposed in the body, wherein the actuator comprises a first ring that moves linearly without rotating with respect to the body;

increasing a pressure of a fluid in the wellbore to a first level to perform a wellbore operation;

decreasing the pressure of the fluid after the pressure reaches the first level; and increasing the pressure of the fluid to a second level that is less than or equal to the first level to actuate the downhole tool and to allow fluid flow through the downhole tool, wherein the downhole tool comprises a main sleeve disposed in the body, the main sleeve being configured to move between a first position in which the main sleeve blocks fluid flow through the one or more openings and a second position in which the main sleeve allows fluid flow through the one or more openings, and wherein the actuator is configured to actuate from a first state to a second state in response to the pressure reaching the first level, and to a third state in response to the pressure reaching the second level, wherein actuating the actuator to the third state causes the main sleeve to move from the first position to the second position.

18. The method of claim 17, wherein the actuator further comprises:

a first drive sleeve positioned in the body; and a second drive sleeve positioned in the body, wherein the second drive sleeve defines a first recess and a second recess in an outer surface thereof, wherein the first ring is positioned between the first and second drive sleeves, wherein the first ring is positioned in the first recess in the second drive sleeve when the actuator is in the first state, the second state, or both, wherein the first ring is positioned in the second recess in the second drive sleeve when the actuator is in the third state, and wherein the first recess in the second drive sleeve is downstream from the second recess in the second drive sleeve.

19. The method of claim 18, wherein the actuator further comprises a second ring positioned between the second drive sleeve and the body, wherein the second ring is positioned in a first recess in the body when the actuator is in the first state, wherein the second ring is positioned in a second recess in the body when the actuator is in the second state, the third state, or both, wherein the first recess in the body is upstream from the second recess in the first drive sleeve, and wherein the second ring moves linearly without rotating between the first recess in the body and the second recess in the body.

20. The method of claim 17, wherein the wellbore operation comprises pressure testing a casing disposed in the wellbore.

* * * * *